US005887517A

United States Patent [19]

Liang et al.

[11] Patent Number: 5,887,517

[45] **Date of Patent: *Mar. 30, 1999**

[54] MULTIPLE HARDNESS ROLL COVER

[75] Inventors: Shihua Liang, Roscoe, Ill.; Rex A. Becker, Janesville, Wis.

[73] Assignee: Beloit Technologies, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 957,084

[22] Filed: Oct. 24, 1997

[51] Int. Cl.[6] ..... B30B 3/04; D21G 1/02; F16C 13/00

[52] U.S. Cl. ..... 100/327; 100/155 R; 100/176; 492/56

[58] Field of Search ..... 100/155 R, 176, 100/327, 328, 330, 334, 335, 336; 492/20, 46, 56

[56] References Cited

U.S. PATENT DOCUMENTS

| | | | |
|---|---|---|---|
| 2,031,872 | 2/1936 | Wightman | 492/56 |
| 2,685,548 | 8/1954 | Drozdowski | 100/176 |
| 2,959,119 | 11/1960 | Gould et al. . | |
| 3,152,387 | 10/1964 | Macleod | 492/56 |
| 3,312,757 | 4/1967 | McRitchie | 100/155 R |
| 3,395,636 | 8/1968 | Hess | 100/330 |
| 3,395,638 | 8/1968 | Kirkus et al. . | |
| 3,437,032 | 4/1969 | Manghirmalani et al. . | |
| 3,447,600 | 6/1969 | Greene | 492/46 |
| 3,779,051 | 12/1973 | Kuesters | 100/176 |
| 3,942,230 | 3/1976 | Nalband . | |
| 4,256,034 | 3/1981 | Kusters et al. | 100/176 |
| 4,501,482 | 2/1985 | Stryjewski | 492/56 |
| 4,534,829 | 8/1985 | Ahrweiler et al. | 100/176 |
| 4,571,798 | 2/1986 | Adams | 100/176 |
| 4,887,340 | 12/1989 | Kato et al. . | |
| 4,998,333 | 3/1991 | Skyttä . | |
| 5,092,235 | 3/1992 | Rise | 100/176 |
| 5,240,198 | 8/1993 | Dörfel . | |
| 5,253,027 | 10/1993 | Goto . | |
| 5,257,967 | 11/1993 | Gysin . | |
| 5,312,662 | 5/1994 | Ohta et al. . | |
| 5,376,448 | 12/1994 | Suzuki et al. . | |
| 5,400,707 | 3/1995 | Neider et al. . | |
| 5,474,850 | 12/1995 | DelRosario et al. . | |
| 5,553,806 | 9/1996 | Lucas . | |
| 5,609,554 | 3/1997 | Hayashi et al. . | |
| 5,655,444 | 8/1997 | Kayser et al. | 100/155 R |

FOREIGN PATENT DOCUMENTS

| | | | |
|---|---|---|---|
| 1-286890 | 11/1989 | Japan | 100/155 R |
| 2-259186 | 10/1990 | Japan | 492/56 |

*Primary Examiner*—Stephen F. Gerrity
*Attorney, Agent, or Firm*—Lathrop & Clark LLP

[57] ABSTRACT

A soft nip calender employing a compliant roll constructed of circumferentially superpositioned layers of compliant material which are progressively less compliant as the layers approach an underlying steel roll.

5 Claims, 1 Drawing Sheet

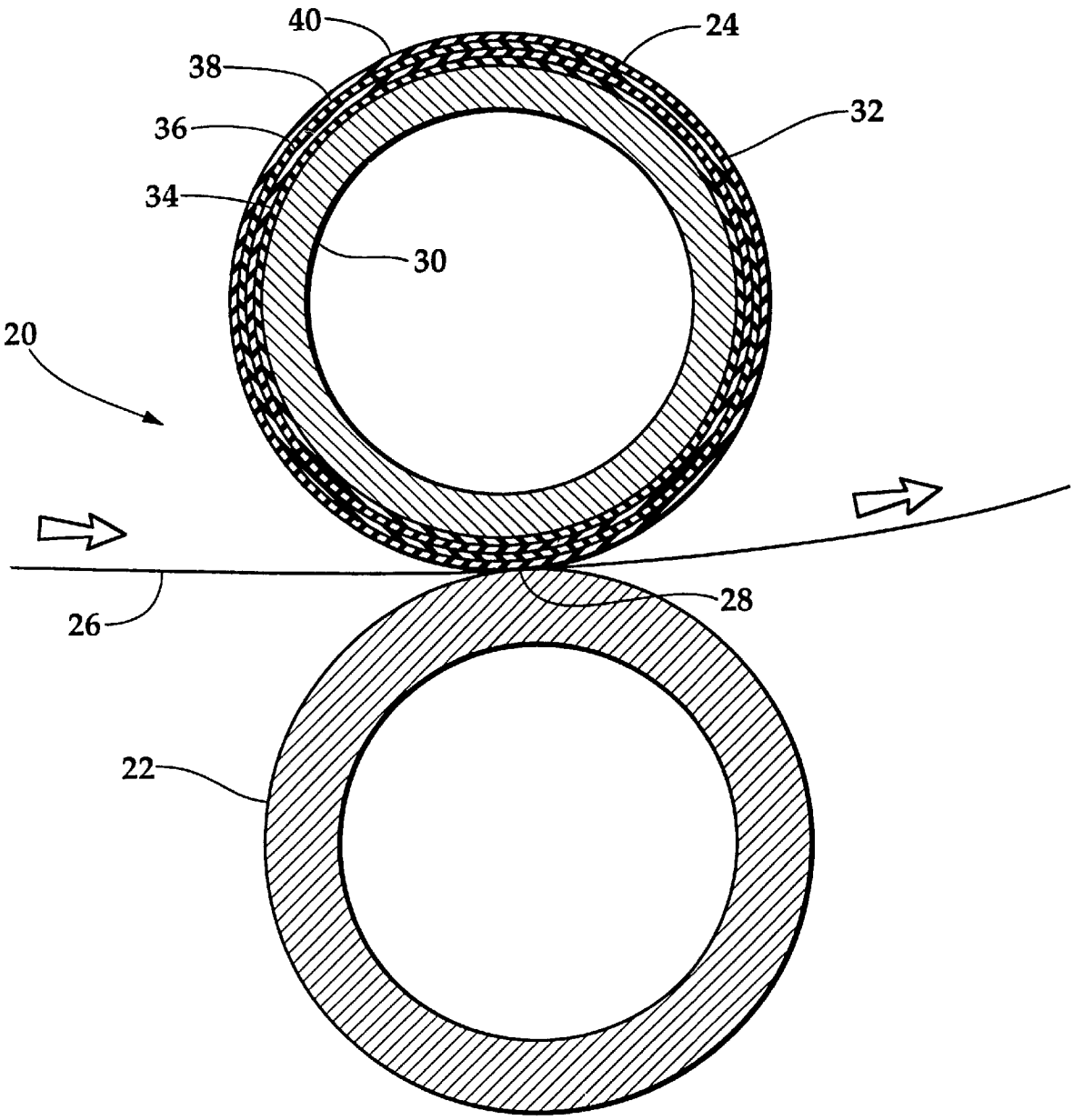
40
24
38
32
36
34
30
20
28
26
22

MULTIPLE HARDNESS ROLL COVER

FIELD OF THE INVENTION

The present invention relates to coverings for rolls used in the papermaking process in general and to compliant roll coverings for gloss calenders in particular.

BACKGROUND OF THE INVENTION

Calenders are employed in the papermaking industry to improve or modify the surface finish of a paper web. Calenders can also be used to modify the thickness of the paper web or to even out the thickness along or across the web.

A major function of paper calenders is to improve the surface finish of paper which can improve both its appearance and printability. A calender functions by employing pressure to smooth the surface of a paper web as it passes the rolls. One or more of the rolls may be heated.

Supercalenders are comprised of multiple rolls stacked one above the other forming a plurality of nips through which the paper web is passed. Supercalendering is often accomplished on the papermaking machine just prior to forming the paper web into a reel on a winder. Supercalenders are also used in off-machine applications, in combination with reminders, to improve the surface finish of paper on reels. Supercalenders are used to increases the amount of calendering by increasing the length of time the paper web spends transiting a nip by increasing the number of nips. Supercalenders have also employed rolls with compliant covers which form nips of increased length, thus increasing the amount of surface improvement which can be accomplished in passing through each of the nips formed by a supercalender.

Supercalenders have some drawbacks in that the multiplicity of stacked calender rolls adds to the complexity and cost of a calender. Supercalenders also require more time to change calender rolls. Roll change out is often required when the paper grade being processed is changed. Supercalenders can present additional problems upon machine startup or when a paper break occurs because of the multiplicity of nips which are required to be threaded.

For many grades of paper, it has been found that the supercalender can be replaced by a calender of the gloss type. A gloss calender, or a soft calender, typically employs two rolls forming a single nip, or two pairs of rolls forming two nips. The soft calender has one roll with a compliant cover opposed to a hard surfaced heated roll. When the soft nip calender is run at high nip loads of up to 3,000 pounds per linear inch (PLI), one or more soft nip calenders can perform the supercalender function with certain grades of paper. Where the soft nip calender can be used, increased economies are achieved by the greater simplicity of the soft nip calender over that of the supercalender.

Compliant roll covers have typically been manufactured of leather, rubber or specialized synthetic materials such as polyurethane.

There is a significant detriment to using a roll with a compliant surface in a gloss calender. Modern gloss calenders operate with the hard noncompliant roll at a temperature as high as 400° to 500° F., and compliant rolls have limited capability for withstand high temperatures. Hysteresis effects in the compliant roll surface produce heating which aggravates the problem of roll heating. The high temperature and high pressures used in the gloss calender can also create a potential for failure of the roll cover causing it to separate from the metallic shell to which the compliant roll surface is attached. The continual increase in the speed at which paper is formed, from less than 3,000 feet per minute to over 6,000 feet per minute, with the future holding the likelihood that speeds of over 9,000 feet per minute will be reached relatively soon, adds urgency to the need to develop roll covers with reduced hysteresis losses.

One approach to overcoming the limitations of compliant rolls as used in gloss calenders is disclosed in U.S. Pat. No. 5,546,856 to Neider et al. which discloses a compliant belt which is passed through a calender opposite a heated roll. The belt reduces some of the problems produced by hysteresis in a compliant roll in a gloss calender, however at the cost of adding additional complexity and cost to the gloss calender.

The effectiveness of the calender requires the highest temperature possible in the heated roll without overheating the compliant surface. By reducing the hysteresis-generated heat, the amount of heat the compliant roll can accept from the heated roll is increased.

What is needed a roll cover which reduces shear stresses between a roll cover and a steel roll and which reduces internal heat generation due to hysteresis.

SUMMARY OF THE INVENTION

The soft nip or gloss calender of this invention has a compliant roll constructed of circumferentially positioned layers of compliant material which become progressively less compliant as the layers approach an underlying steel roll.

It is a feature of the present invention to provide a gloss calender with a compliant roll which has reduced hysteresis heating.

It is a further feature of the present invention to provide a gloss calender with a compliant roll which resists de-bonding of the compliant roll cover from the metal base roll.

It is another feature of the present invention to provide a gloss calender with a compliant roll which can be used at higher speeds or with a higher temperature heated roll.

Further objects, features and advantages of the invention will be apparent from the following detailed description when taken in conjunction with the accompanying drawing.

BRIEF DESCRIPTION OF THE DRAWINGS

The figure is a schematic cross-sectional view of the gloss calender of this invention.

DESCRIPTION OF THE PREFERRED EMBODIMENT

Referring more particularly to the figure, a soft nip calender 20 is shown. The calender 20 has a heated metal roll 22 in nipping engagement with a compliant roll 24. A paper web 26 passes through the nip 28 formed between the heated roll 22 and the compliant roll 24. The compliant roll 24 has an inner metal shell 30 and an outer compliant covering 32 which is constructed of four layers: an inner layer 34, a second layer 36, a third layer 38, and an outer layer 40.

To increase the performance of the soft nip calender 20, the temperature of the heated roll 22 can be increased. The temperature will be a minimum of 200° Fahrenheit. By circulating heated oil through the metal roll 22, the temperature can be raised to about 350° F. Through the use of induction heaters the temperature of the roll 22 can be increased to 500° to 600° F. Temperatures higher than this typically result in scorching of the paper and excessive heating of the compliant roll 24.

Performance of the soft nip calender is further improved by increasing the width of the nip 28 to increase the dwell time of the web 26 in the nip 28. Increasing the nip width is accomplished by making the compliant cover 32 softer. However if this is done with a single layer of soft material, two problems with soft calender rolls are aggravated. The first is that the cover is more likely to separate from the inner metal shell 30 because of the greater shear stress at the interface between the cover and the metal shell. The second problem is that the greater deflection in the thickness of the cover results in greater hysteresis heating.

The soft cover compliant roll 24 overcomes this problem by using multiple layers 34, 36, 38, 40 which are progressively softer as distance from the metal shall 30 increases. The first layer 34 has a very high hardness 0–4 Pusey and Jones. The second layer 36 is slightly softer with a hardness of 5 to 10 Pusey and Jones. The third layer 38 has a softer layer with a hardness of 10–15 Pusey and Jones and the final layer 40 has a hardness of 15 to 30 Pusey and Jones.

By using a series of layers with increasing softness the shear at the interface between each layer is reduced so that separation of the roll cover 32 from the metal shell 30 is reduced. Because the last layer 40 is relatively thin, it can be softer, thus allowing for a greater nip width and so greater calendering effect.

Ideally the hardness or durometer of the roll cover would vary continuously from the shell 30 to the surface of the roll cover 32. However practical considerations suggest that separate layers be used to develop the roll properties. Materials suitable for achieving the properties required for the roll cover 32 include polyurethane, which can be formulated in a wide range of hardnesses. Another approach is to employ rubber with varying additives and varying levels of vulcanization.

It should be understood that the thickness of the compliant cover may vary depending on the paper being processed, and that a typical thickness for the cover would be between about one inch and two inches. The upper most there will have a thickness of between 0.5 and 0.8 inches to allowed for refinishing the roll surface. The first layer and the intermediate layers will typically have a thickness of about 0.3 inches.

It should be understood that the soft nip calender 20 of this invention will typically have a load of about 2,000 lbs per linear inch in the cross machine direction. Nevertheless, soft nip calenders including gloss calenders can have nip loads between 1,000 and 3,000 lbs per linear inch or higher.

It should be understood that the Pusey & Jones system for measuring as described in ASTM designation: D531-85 can be correlated with the A-scale durometer or shore A system with a Pusey and Jones of 30 corresponding to 80 Shore A, a Pusey and Jones of 25 corresponding to 87 Shore A, a Pusey and Jones of 20 corresponding to 90 Shore A, a Pusey and Jones of 15 corresponding to 94 Shore A and a Pusey and Jones of 8 corresponding to 98 Shore A.

It should be understood that a metal inner roll is herein defined to include a metal roll over wrapped with fiberglass or other very hard composite material which serves to improve bonding between the compliant layers and the metal roll.

It should be understood that the preferred compliant roll cover material will be polyurethane.

It is understood that the invention is not limited to the particular construction and arrangement of parts herein illustrated and described, but embraces such modified forms thereof as come within the scope of the following claims.

We claim:

1. An improved soft calender of the type comprising:

a metal roll with a temperature in excess of 200° F.;

a compliant roll in nipping engagement with the metal roll and defining a nip therewith; and a paper web passing through the nip; wherein the improvement comprises:

the compliant roll having a metal inner roll and a first compliant layer bonded to the metal inner roll, the first compliant layer having a hardness of about Pusey and Jones 0 to about 4;

the compliant roll having an uppermost compliant layer having a hardness of about Pusey and Jones 15 to about 30 and a thickness of between about 0.5 and 0.8 inches; and the compliant roll having at least one first intermediate compliant layer positioned between and bonded to the first compliant layer and the uppermost compliant layer, the first intermediate compliant layer having a hardness which is less than the hardness of the first compliant layer and greater than the hardness of the uppermost compliant layer.

2. The improved soft calender of claim 1 wherein the first intermediate compliant layer has a hardness of about Pusey and Jones 5 to about 10 and further comprising a second intermediate compliant layer positioned between and bonded to the first intermediate compliant layer and the uppermost compliant layer and having a hardness of about Pusey and Jones 10 to about 15.

3. The calender of claim 2 wherein the first compliant layer and the intermediate layers have a thickness of about 0.3 inches.

4. An improved soft calender of the type comprising:

a metal roll with a temperature in excess of 200° F.;

a compliant roll in nipping engagement with the metal roll and defining a nip therewith; and a paper web passing through the nip; wherein the improvement comprises:

the compliant roll having a metal inner roll and a compliant cover bonded to the metal inner roll, the compliant cover having a hardness varying from Pusey and Jones 0 where the cover joins the metal inner roll, to about Pusey and Jones 15 at an outermost portion of the cover and further comprising an outer layer having a thickness of between 0.5 and 0.8 inches with a constant hardness.

5. An improved soft calender of the type comprising:

a metal roll with a temperature in excess of 200° F.;

a compliant roll in nipping engagement with the metal roll and defining a nip therewith; and a paper web passing through the nip; wherein the improvement comprises:

the compliant roll having a metal inner roll and a compliant cover bonded to the metal inner roll, the compliant cover having a hardness varying from Pusey and Jones 0 where the cover joins the metal inner roll, to about Pusey and Jones 30 at an outermost portion of the cover and further comprising an outer layer having a thickness of between 0.5 and 0.8 inches with a constant hardness.

* * * * *